US007320610B2

(12) United States Patent
Boike

(10) Patent No.: US 7,320,610 B2
(45) Date of Patent: Jan. 22, 2008

(54) POWER-RAIL ADAPTER AND POWER RAIL

(75) Inventor: Martin Boike, Wickede/Ruhr (DE)

(73) Assignee: Erco Leuchten GmbH, Ludenscheid (DE)

( * ) Notice: Subject to any disclaimer, the term of this patent is extended or adjusted under 35 U.S.C. 154(b) by 0 days.

(21) Appl. No.: 11/409,560

(22) Filed: Apr. 21, 2006

(65) Prior Publication Data

US 2007/0015388 A1 Jan. 18, 2007

(30) Foreign Application Priority Data

Apr. 26, 2005 (DE) ..... 10 2005 019 632

(51) Int. Cl.
*H01R 25/00* (2006.01)

(52) U.S. Cl. ..... 439/121

(58) Field of Classification Search ..... 439/121, 439/110, 122

See application file for complete search history.

(56) References Cited

U.S. PATENT DOCUMENTS

| | | | | |
|---|---|---|---|---|
| 4,979,081 | A * | 12/1990 | Leach et al. | 362/219 |
| 5,664,876 | A * | 9/1997 | Vafai et al. | 362/249 |
| 5,903,426 | A | 5/1999 | Ehling | 361/119 |
| 6,042,399 | A * | 3/2000 | Jaakkola | 439/122 |
| 6,203,339 | B1 * | 3/2001 | Nieminen | 439/118 |
| 6,994,571 | B2 * | 2/2006 | Hoffmann | 439/110 |
| 7,086,875 | B2 * | 8/2006 | Hoffmann | 439/119 |

FOREIGN PATENT DOCUMENTS

| | | |
|---|---|---|
| DE | 391382 | 9/1990 |
| DE | 19743047 | 4/1999 |
| DE | 10212232 | 10/2003 |
| DE | 10312012 | 11/2004 |
| DE | 202004020011 | 4/2005 |
| GB | 1471985 | 4/1977 |
| WO | WO/82/03297 | 9/1982 |

* cited by examiner

*Primary Examiner*—Neil Abrams
*Assistant Examiner*—Phuongchi Nguyen
(74) *Attorney, Agent, or Firm*—Andrew Wilford

(57) ABSTRACT

A power-rail adapter (39) for mechanical and electrical connection of a light fixture (10) and/or of an operating unit (15) of the light fixture with a power rail (28), comprising at least a switch shaft (41) that can be pivoted between a removing position in which the adapter is removable from the power rail and an installing position in which the adapter is fixed to the power rail is illustrated and described.

A specific feature is amongst others that a coding stud (66) is provided on the switch shaft and that a coding groove (77) is provided at the power rail in which the coding stud can be introduced only with a single relative orientation of the adapter (39) with respect to the power rail (28) with pivoting of the switch shaft from the removing position into the installing position.

17 Claims, 9 Drawing Sheets

POWER-RAIL ADAPTER AND POWER RAIL

FIELD OF THE INVENTION

The invention to start with relates to a power-rail adapter for mechanical and electrical connection of a light fixture and/or of an operating unit of the light fixture with a power rail, comprising at least a switch shaft that can be pivoted between a removing position in which the adapter is removable from the power rail and an installing position in which the adapter is fixed to the power rail.

BACKGROUND OF THE INVENTION

Power-rail adapters of the above-described type are the state of the art. They serve for the connection of a light fixture, in particular a spotlight fixture, with a power rail and at the same time provide for a mechanical fixation, that is, a fixation of the fixture on the building surface, in particular on the ceiling of a building and at the same time for the electric connection of the light fixture with conductors in the power rail. Light fixtures that can be connected to a power rail via a power-rail adapter are also well known and quite common. They have as well been fabricated by applicant for decades.

First, a light fixture that is not suitable for connection to a power rail by means of a power-rail adapter will be described for providing background information and a better understanding of the invention. As an example, reference is here made to a focal flood fixture that is described in the current catalogue of applicant in the 2004/2005 edition on page 486 and the following and that has several differently colored light sources. The light sources are connected to power-supply lines that provide line voltage or operating voltage for the light sources. Furthermore, the fixture has three electronic ballasts so that the three light sources can be controlled individually. The ballast can for example be a ballast functioning according to the DALI protocol that can be addressed individually and that is connected to a signal line. The light fixture can be integrated into a lighting system and can receive control information from a central controller via the signal line. For example, it is possible to transmit instructions from the central controller to one of the light sources of the light fixture to switch to a particular dimming state, e.g. for the purpose of mixing colors, to blink, to switch on, to switch off, or the like.

The power-supply line, which generally is associated with a phase conductor and a null conductor, is typically connected to the light fixture via a first conductor and transfers for example an operating voltage of 230 VAC or 110 VAC. For connection of the signal line, a second connection is provided on the light fixture or on the operating unit assigned to the light fixture, that is, e.g. the electronic ballast. The signal line typically is a two-conductor line that transfers voltages up to 25 V for example. The signal line is normally physically separate from the power-supply lines.

In a light fixture of this type that consequently disposes of a connection for a power-supply line and of a connection for a signal line for receiving control information, there exists a need to connect such a light fixture via a power-rail adapter to a power rail.

OBJECT OF THE INVENTION

On this basis, the object of the invention consists in further developing a power-rail adapter of the known type as for example described in commonly owned U.S. Pat. No. 6,994,571 such that connection of a light fixture is possible in an easy and safe manner and a power-supply line conductor and a signal-line conductor can be used.

SUMMARY OF THE INVENTION

This object is resolved by the invention in that a coding stud is mounted on the switch shaft and that the power rail is provided with a coding groove in which the coding stud can only be introduced in a relative position of the adapter relative to the power rail when switching the switch shaft from the removing position into the installing position.

The principle of the invention thus substantially consists in assigning a coding stud to the switch shaft that can be introduced into a coding groove on the power rail. The power rail has a single coding groove that only fulfils a coding function. The coding stud therefore in particular neither has the function of mechanical fixation nor that of mechanical contacting of a conductor in the power rail, but only serves for assuring a specific orientation of the power rail adapter relative to the power rail. Thus, incorrect mounting can be avoided.

It is to be noted that in particular power rails present in the US-market typically have two phase conductors and two null conductors. standard power-rail adapters can be inserted depending on the desired orientation into the known power rail as shown in FIG. 1 of the present patent application. The adapter can modify its orientation by rotation and thus access different phase or null conductors.

However, in case a light fixture is to be connected to a power rail that has a signal-line conductor and a line-voltage conductor, one must avoid applying high operating voltages to the signal-line conductor. If an incorrect mounting occurs, that is, an incorrect connection of the lines, so that the far higher operating voltage is accidentally applied to the second connection for the signal line, the light fixture or the signal-line conductor could be damaged or be adversely affected.

By means of the coding stud on the switch shaft and the coding groove on the power rail, an incorrect mounting due to wrong orientation of the adapter on the power rail can be excluded. Fixation of the adapter on the power rail, that is, a pivoting of the switch shaft from its removing position into its installing position is only possible if the power-rail adapter is correctly oriented relative to the power rail and therefore introducing the coding stud into the coding groove is possible. In case the power-rail adapter is oriented incorrectly relative to the power rail, the coding stud does not meet the provided coding groove so that a complete pivoting of the switch shaft into the installing position cannot occur. The operating person will notice this fact and detect an incorrect installing position. The operating person can immediately compensate after having noticed the defective mounting the orientation of the power-rail adapter relative to the power rail and carry out a correct installation.

Otherwise, if the high operating voltage of for example 230 V met e.g. a 12 V low voltage transformer, copper could be vaporized, which beside direct health damage affecting the installer would also involve in a disadvantageous manner damage to the electric and electronic parts of the light fixture, in case insulating parts or areas are made conductive after a precipitation of the copper on them, which can entail further consequential damage. Other damage to parts of the light fixture or of the operating unit are possible.

According to an advantageous embodiment of the invention, the light fixture has an operating unit on which the first and/or the second connection is mounted. The operating unit of the light fixture can for example be an electronic ballast, a transformer or another device that is directly assigned to the light fixture and by means of which the function of the light fixture can be controlled. The operating unit typically is mounted directly in close proximity to the light fixture and can for example be in the housing of the light fixture or in a separate operating-unit housing. The operating unit can also be within a housing of the power-rail adapter.

According to a further advantageous embodiment of the invention, the control information corresponds to the DALI protocol (Digital Addressable Lighting Interface). This protocol, which has been elaborated by the Arbeitsgemeinschaft DALI beim Zentralverband der deutschen Elektrotechnik- und Elektronik-industrie e. V. (ZVEI) (working committee at the umbrella association of German electrical engineering and electronics industry), is for example described in detail in the previously published handbook DALI of the DALI AG, 2nd edition, 2001, editor Richard Pflaum Verlag Munich.

An operating unit can be part of the light fixture or can be mounted separately from the light fixture, preferably in direct proximity to the light fixture. In addition to electronic ballast devices also other devices can be possible operating units of the light fixture by means of which the light fixture can be dimmed, switched on or off or by means of which the radiation behavior or the color of the light fixture can be influenced in another manner or by means of which a light source of the light fixture can be controlled.

The operating unit typically has a first connection for connecting with a power-supply line by means of which the supply voltage for operating the light source of the light fixture is transmitted. The operating unit furthermore has a second connection for a signal transmission by means of which control information for controlling the light fixture is transmitted. The control information can for example be formatted according to the DALI protocol.

An output of the operating unit is typically connected to the light source so that the operating unit can control the light source or the light sources according to the received control information or control commands of the operating unit.

The invention furthermore relates to a power rail comprising at least a first conductor and at least a second conductor both of which can be connected to one or to two light fixtures for their supply with operating voltage.

The known power rail has been fabricated for example for decades under the denomination three-phase power rail by applicant. It typically comprises three phase conductors and one null conductor by means of which a light fixture or several light fixtures can be supplied with operating voltage. For the US market, applicant has been fabricating two-phase power rails for decades that have two phase conductors and two null conductors.

A power-rail adapter can be inserted into the power rail that is designed as a U-profile and can be locked mechanically and electrically with the power rail.

The object of the invention consists in further developing the power rail such that the control of the light fixtures is simplified.

The invention resolves this object in that a circuit is provided that connects one of the two conductors as signal conductor for transferring control information to the light fixture.

The principle of the invention substantially consists in the fact that a standard power rail, e.g. a two-phase and a 2-null conductor power rail is connected by a circuit such that one or several of the standard conductors, preferably two conductors, are used in the standard way for supplying power to the light fixture, and at least one, advantageously two, of the standard conductors are used in a new manner for signal transmission for transferring control information to the light fixture.

Due to the arrangement of the circuit, existing power rails that are installed in a building in a fixed manner can be used for controlling light fixtures that e.g. have a DALI ballast or a DALI operating unit. The DALI light fixtures can receive their control information via the existing power rail without the need of installing additional lines. Thus, there is very little installation expense, since it solely requires a modification of the wiring of the power rail. Existing two-phase power rails can thus be easily retrofitted.

The novel circuit can preferably comprise a circuit element that connects an end of the power rail with a central controller for a network of light fixtures.

The invention enables one to have recourse to existing power rail systems that solely have to be connected in a way different from the standard connecting way, the power rail not being connected with two phase conductors and two null conductors but with one null conductor and one phase conductor and with an operating unit of the DALI network or of another network.

According to an advantageous embodiment of the invention, a tag is mounted on the power rail that indicates that one of the conductors is used for transmitting control information.

This enables a particular easy way of indicating in which mode the power rail is operated or how the power rail is being operated. The person who wants to connect a light fixture to the power rail can in this manner verify very quickly if the power rail is operated as a standard two-phase power rail or in the manner according to the invention as a one-phase power rail that has two control lines.

Further, the tag can advantageously be attached to the power rail in a removable manner so that it can be used as an additional element or as accessory element. It is further advantageous that the tag be clipped to the power rail so that without separate means, the tag can be mounted on the power rail.

In conclusion, the invention relates to a power-rail adapter for mechanical and electrical connection of a light fixture and/or of an operating unit of the light fixture with a power rail.

Such a power-rail adapter is for example known from above-cited U.S. Pat. No. 6,994,571 for the purpose of avoiding repetitions and whose content is included herewith also for the purpose of recourse to particular features or groups of features into the content of the present patent application.

The known power-rail adapter serves for the mechanical and electric connection of a light fixture with a power rail. In the same manner, the adapter can also serve for providing the mechanical and electric connection of the operating unit with the power rail, if an operating unit is present, as well as possibly for providing the connection for the light fixture. The operating unit can for example also be incorporated in the housing of the power-rail adapter.

The known power-rail adapter of applicant functions in an advantageous manner with only few components and enables particularly easy mounting. The known power-rail adapter therefore has a first and a second switch shaft that on the one hand has a phase-conductor contact and on the other hand has a null-conductor contact by means of which the conductor bars in the power rail can be contacted.

On the basis of this prior art, the object of this invention consists in further developing a power-rail adapter for mechanical and electrical connection of a light fixture and/or of an operating unit of the light fixture with a power rail such that also a light fixture that has a first connection for connection with a power-supply line and a second connection for connection with a signal line and having a simple structure can be connected to the power rail.

The invention resolves this object in that each switch shaft has two contact elements that are connected to the switch shaft in a rotary manner.

The principle of the invention substantially consists in the fact that two contact elements are assigned to both switch shafts. All contact elements can be placed in the switch shafts due to an advantageous positioning despite of the limited space. Each contact element has a plug element, preferably a plug terminal. The plug element can be connected to a line conductor that has a mating plug element. The mating plug element can for example be a flat pin bushing.

The plug element, preferably each plug element, is disposed near the pivot axis of the respective switch shaft. Moreover, the plug element, preferably each plug element, is substantially oriented next to the pivot axis of the respective switch shaft, that is, parallel to the respective pivot axis. Due to this arrangement, the bending load of the line conductors is minimized as a result of a pivotal or rotational movement of the switch shaft. Damaging of the conductors is thus practically excluded.

Due to the fact that two contact elements are assigned to each switch shaft, recourse can be made to the standard structure of the adapter described in U.S. Pat. No. 6,994,571. Each switch shaft has a rotation axis that in the mounted stated is oriented substantially perpendicular to the longitudinal axis of the power rail. The operating surfaces for rotation of the respective switch shaft accordingly are situated out of the inner space of the power rail and enable comfortable access for a user with the possibility of transmitting high torque. Typically, the operating surfaces are provided on a broad axial portion of the respective switch shaft or on a separate operating lever.

The pairwise distribution of the in total four required contact elements for the contacting of a null conductor, of a phase conductor and of two signal lines to two separate switch shafts enables small operating forces to rotate the switch shafts. In contrast to a power-rail adapter of applicant that is known from prior use in which by means of an operating wheel that is pivotable about a rotational axis that is situated in the longitudinal axis of the power rail and in which, as a result of the rotation of the operating wheel, four contacts can be simultaneously extended, the operating forces are practically halved in the construction according to the invention providing two switch shafts each for two respective contact elements, which facilitates operation. Furthermore, with two switch shafts, there is the possibility of locking the switch shafts against each other so that a first switch shaft can be actuated when a second switch shaft has already been actuated, as already provided in the known power-rail adapter according to U.S. Pat. No. 6,994,571.

Advantageously, the power rail has a common outlet for all four or more conductors. This way, it is furthermore advantageous if a switch shaft on which two contact elements are disposed has an opening for at least two further conductors, these two conductors contacting the plug element of the contact elements of the respective other switch shaft.

Furthermore, it is advantageous if the plug elements of one switch shaft, for example of the switch shaft that has the contact elements for contacting the signal lines is oriented in the mounted state of the power-rail adapter to the floor of the power rail, while the plug elements of the contact elements of the other switch shaft are spaced away from the floor of the power rail. This enables a particularly advantageous guiding of conductors within the power-rail adapter as well as the easy possibility of providing a common outlet for all conductors on the power-rail adapter.

Due to the arrangement of the plug elements on the contact elements, the mounting of the power-rail adapter can easily be effected. Moreover, the power-rail adapter can be fabricated with only small number of components. It is surprising that despite the limited space for the contacts in the power rail due to the dimensions that are determined by the inlet slot in the power rail, an arrangement of two contact elements on one switch shaft is possible. Advantageously, the two contact elements are separated from each other by a plastic or another electrically insulating material.

In the case of a power rail according to the invention having two switch shafts with respective contact elements, it is furthermore particularly advantageous if one switch shaft has two contact terminals that serve for contacting of the signal lines in the power rail and another switch shaft has two contact terminals that serve for contacting of the phase conductor and the null conductor. The contact terminal can be disposed on one of the two switch shafts, possibly also on both switch shafts.

BRIEF DESCRIPTION OF THE DRAWING

Further advantages of the invention result from the non-cited subclaims as well as from the following description of examples of embodiments shown in the figures. Therein:

SPECIFIC DESCRIPTION

Figure 1:
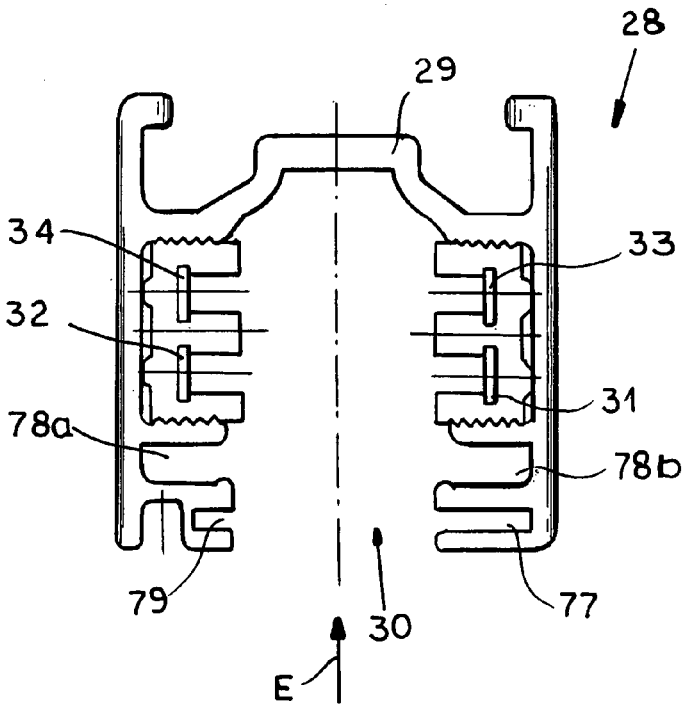
FIG.1 PRIOR ART
FIG. 1 is a schematic partially sectional view of a standard two-phase power rail of the prior art that can be operated according to the invention also for transmitting control information.

First, starting from FIG. 3 an embodiment of a novel light fixture 10 will be explained. It will be noted that in the following description for the sake of clarity like or comparable parts or elements are referred to with same reference numbers some times with the addition of lower-case letters.

The novel light fixture 10 comprises as is standard a housing 11 in whose interior 12 a light source 13 is fixed. The light source 13, such as a light bulb, is supplied with operating voltage through two schematically indicated supply lines 14*a* and 14*b* that connect the light source 13 with a schematically indicated operating unit 15 for the light source 13, such as according to type an electronic ballast. The electronic ballast 15 also has an output 16 for connecting the supply lines 14*a* and 14*b* to a first connection 17 for connecting to power-supply lines 19*a* and 19*b* of a line-voltage source S and a second connection 18 for connecting the operating unit 15 and thus the light fixture 10 to signal lines 20*a* and 20*b* of a remote electronic controller C. The second connection 18 belongs to both the operating unit 15 and the light fixture 10.

The light fixture shown in FIG. 3 corresponds to the basic structure to the prior art, however it contains a removable fuse described below. It is not critical for the invention how many light sources 13 or how many operating units 15 are assigned to the light fixture 10. It is also conceivable that different or differently colored light sources are provided in a light fixture and that they are operable by one or more operating units. Likewise, the novel light fixture 10 or the novel operating unit 15 also can have several first connections 17 and several second connections 18.

Figure 3:
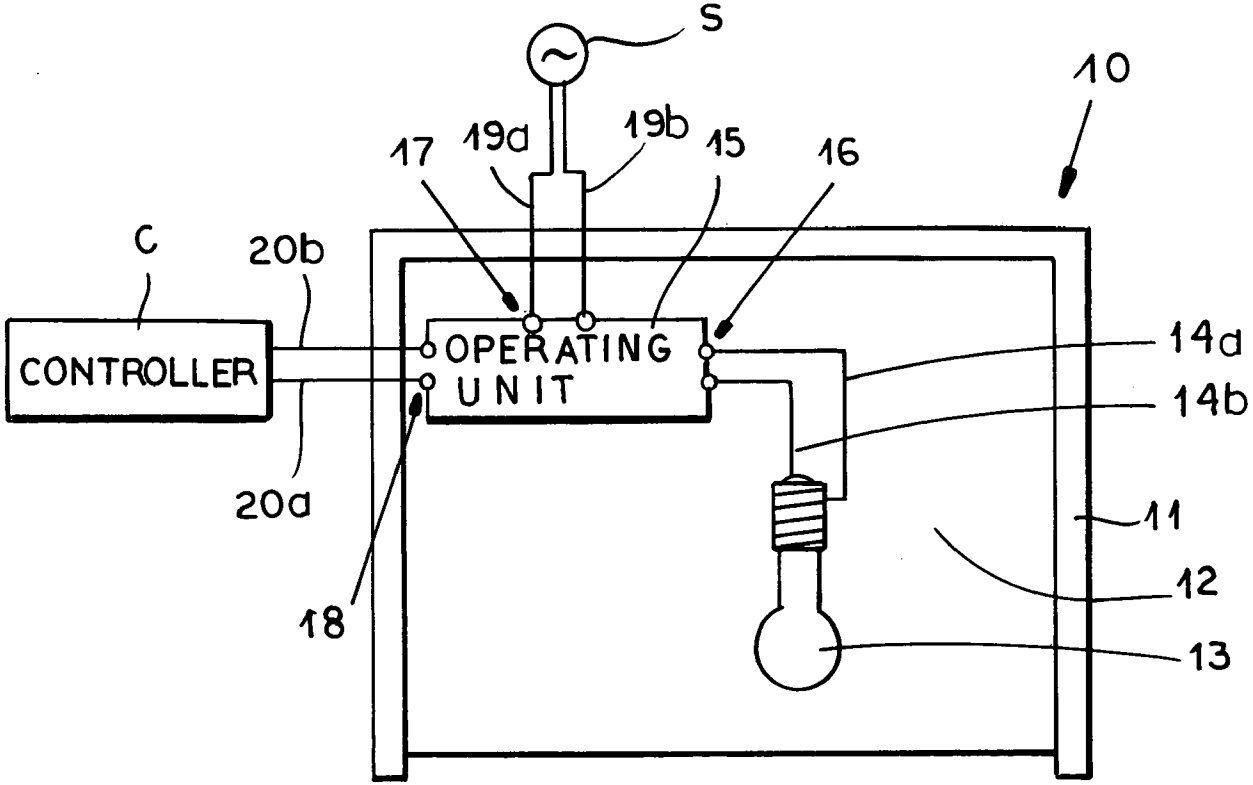
FIG.3 PRIOR ART
FIG. 3 is a very schematic block-diagram representation of a first example of embodiment of a novel light fixture.
Figure 4:
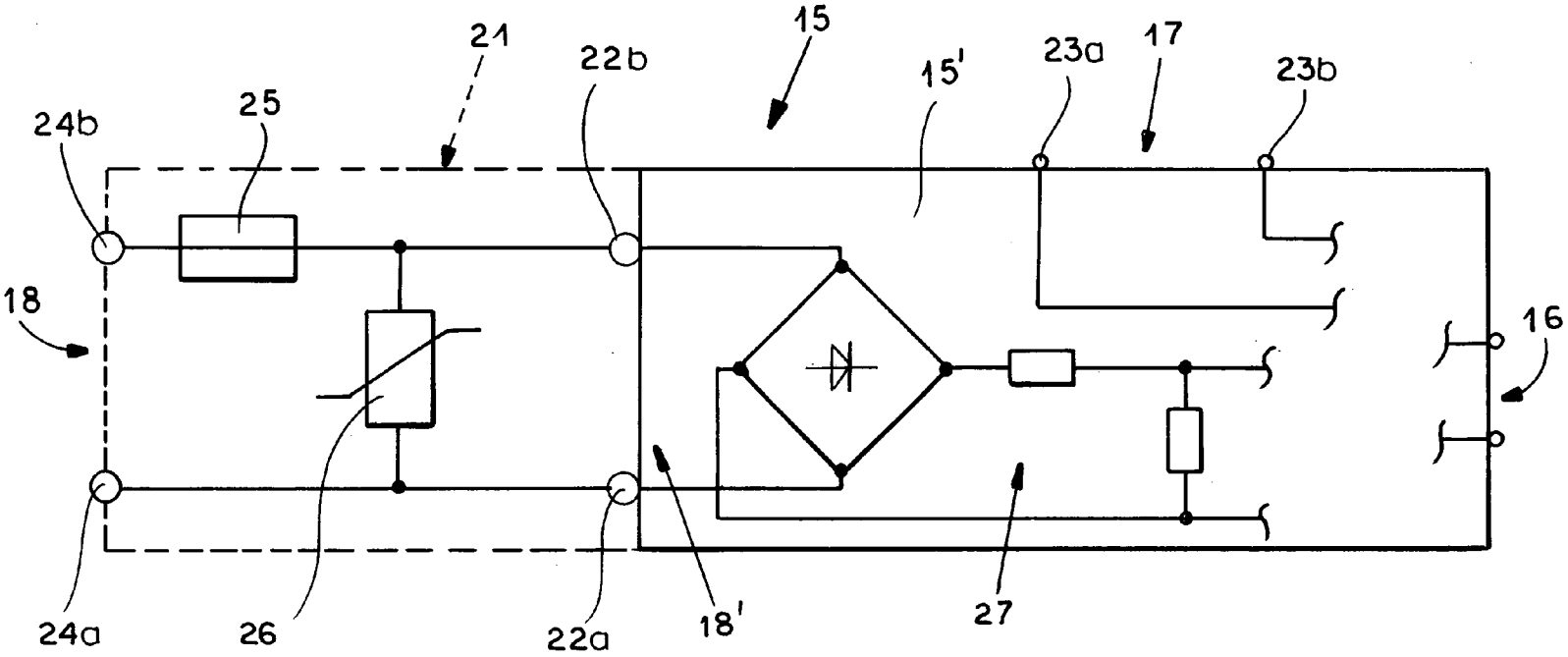
FIG. 4 is a schematic block-diagram representation of a novel circuit connected at the inlet side of a standard operating unit.

FIG. 4 shows as a schematic block diagram a prior-art or standard operating unit 15' functioning as an electronic ballast that can be used in the light fixture 10 according to FIG. 3 as a novel operating unit 15 supplemented with a circuit 21. Thus, the operating unit referred to with 15' in FIG. 4 is an operating unit of the prior art that has an output 16 for the supply lines 14*a* and 14*b* to the light source 13, a first connection 17 with two connection points 23*a* and 23*b* for connecting to the power-supply lines 19*a* and 19*b* as well as a second connection 18' with two connection points 22*a* and 22*b* that serve in the case of the standard operating unit 15' for connecting to the signal lines 20*a* and 20*b*. Thus, the connection points 22*a* and 22*b* represent the inputs of standard electronic ballast 15'.

Upstream of the connection 18' of the standard ballast 15' is the circuit 21 on the input side that has a removable fuse or cutout 25 between the connection points 24*b* and 22*b* and a varistor 26 connected in parallel with the two connection points 22*a* and 22*b*, i.e. a variable resistance. Connected to the connection points 24*a* and 24*b* of the circuit 21 are in case of the novel light fixture 10 or in case of a novel operating unit 15 the signal lines 20*a* and 20*b*.

With reference back to FIG. 3 while operating voltage, such as 230 V alternating current, is supplied through the power-supply lines 19*a* and 19*b* of the light fixture 10, the control information is fed as modulated signals onto the signal lines 20*a* and 20*b* with low power amplitudes, such as up to 20 or 30 V. Normally, i.e. when the light fixture 10 or the operating unit 15 is appropriately connected to the signal lines 20*a* and 20*b* through the second connection 18, only the lower power that transmits the control information is applied at the connection points 24*a* and 24*b* (FIG. 4). Accordingly, only the lower power is also applied at the connection points 22*a* and 22*b*.

If it so happens due to an incorrect installation whose occurrence will be discussed below that a higher power, such as the operating voltage at the level of e.g. 230 V or in case of an misconnection of the two phase conductors a power at a level of 400 V transmitted by the power-supply lines 19*a* and 19*b*, is applied at the connection points 24*a* and 24*b* the varistor 26 that normally disables current flow between the connection points 22*a* and 22*b* can switch into a conductive state. Namely, a varistor 26 has the specific feature that below a threshold voltage it is not conductive for current and above a threshold it becomes conductive for current. If a threshold voltage is chosen, e.g. 60 V, such that the voltage range for transferring the control information is below the threshold and the voltage range that commonly serves the power supply of the light fixture 10 is above the threshold, the varistor 26 becomes conductive for current in the case of an incorrect connection such that a high current flows through the varistor 26. This high current flows at the same time also through the cutout 25 and actuates it.

Advantageously the cutout 25 is designed as fuse and has for example a metal filament disposed in a quartz glass capillary tube filled with sand that melts when a threshold current is exceeded and separates electrically the connection points 24*b* and 22*b* securely, i.e. puncture-proof and permanently from each other after melting thoroughly.

If actuating the fuse 25 results from an incorrect connection of the connection points 24*a* and 24*b* the electronics 27 of the operating unit 15 connected downstream of the connection points 22*a* and 22*b* and incompletely illustrated in FIG. 4 as well as the light sources disposed downstream are protected against excess voltage. After actuating the fuse 25 it is sufficient to switch the fuse 25 with a new fuse after correction of the connection of the signal lines 20*a* and 20*b* of the respective power-supply lines 19*a* and 19*b* without it being necessary to switch the operating unit 15 or parts of the electronics 27. Also the varistor 26 can remain in the circuit 21.

Instead of a standard fusible cutout as used widely in electrical apparatuses and held for example by means of metal spring legs such that it is removable by manual actuation a circuit breaker can also be used which is not shown. It can be designed in a manually resetting way such that a user can reset it after actuation of the fuse 25 and correction of the conductors. Alternatively the fuse also can be designed in an automatically resetting way and return to its conducting state for example after elapse of a certain time of for example 10 or 20 minutes.

It is important that in case of applying an excess voltage to the connection points 24*a* and 24*b* the chosen fuse 25 actuates very quickly such that any damage to the downstream electronics is prevented. For example an FF315 mA 700 V fuse can be considered as fuse 25. The varistor can be for example be an SO5K6O varistor of Siemens. The operating unit referred to with 15' in FIG. 4 can be a standard DALI ballast that can process control information corresponding to the DALI protocol. In this way, the circuit 21 with the fuse 25 and the varistor 26 can be upstream of the standard DALI ballast 15' and also connected to the input 18' of the standard operating unit 15' through for example plug-in connections or other electrical connections.

Alternatively there is also the possibility of incorporating the circuit 21 into an operating unit 15 according to the invention. FIG. 3 indicates this and shows the standard operating unit 15 with the second connection 18 together with the circuit 21 as a single unit.

The second connection 18 of the operating unit 15 according to FIGS. 3 and 4 corresponds at the same time also to the second connection 18 of the novel light fixture 10 because the operating unit 15 is part of the light fixture 10 or belongs to the light fixture 10.

In addition to an electronic ballast also any other arrangement of a light fixture 10 comes into consideration as operating unit that can at least address a light source 13 and is preferably addressable.

The fuse 25 and/or the circuit 21 can be mounted in or on a light fixture 10 separately from an operating unit 15 and for example also form a separate component. Alternatively, also a direct mounting of the fuse 15 or of the circuit 21 into or on the housing of the operating unit 15 or into or on the housing of the light fixture 10 can be carried out. Similarly, the fuse 25 and/or the circuit 21 can be mounted in or on a power-rail adapter described later.

For the sake of clarity, the functional principle of an operating unit 15 will not be discussed further and in FIG. 4 the structure of the standard operating unit 15' will be merely shown very schematically and incomplete with respect to the electronics and circuit. It is important that the operating unit 15 typically has a first connection 17 for power-supply lines, a second connection 18 for signal lines and an output 16 for connecting with at least one light source 13, the control information received through the signal lines 20*a* and 20*b* being able to address, for example dim or switch, the light source 13.

Additionally, it will be noted that although not illustrated in the figures there is also the possibility of associating the fuse 25 and/or the circuit 21 with a power rail and even mounting it on the power rail, for example.

A standard two-phase power rail 28 will be described with reference to FIG. 1 in the following that can be used in the manner of the invention as power rail for transmission of the operating voltage of a light fixture and for transmission of control information.

Figure 5:
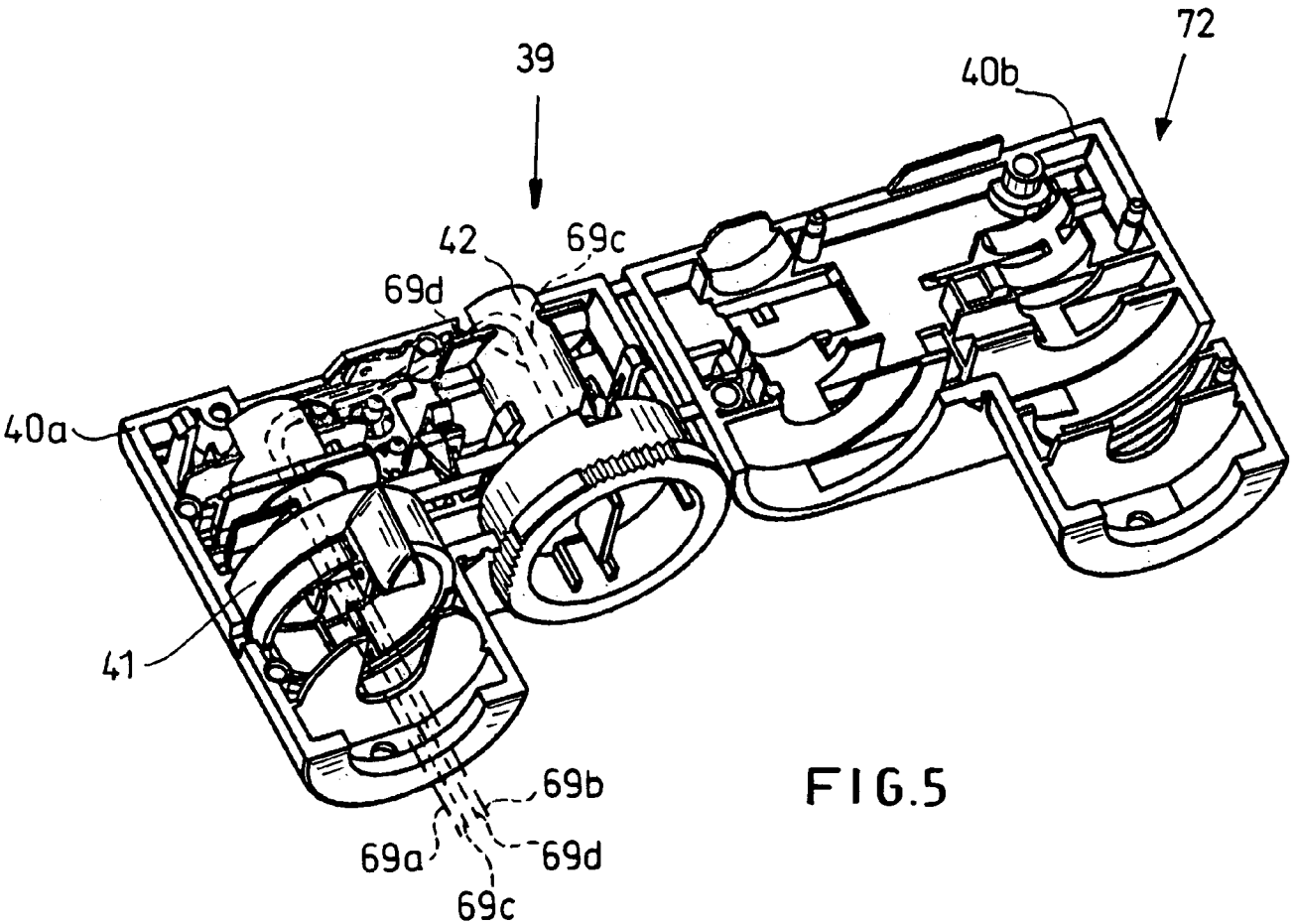
FIG. 5 shows in a perspective, schematic view an example of an embodiment of a power-rail adapter according to the invention having two housing shells in an open position.

The known two-phase power rail 28 consists of a substantially U-shaped profile 29 especially consisting of aluminum that has an inlet slot 30 for the head region 72 of a power-rail adapter 39 (FIG. 5). With respect to the basic function of a power rail 28 and to the mechanical and electrical connection to a power-rail adapter 39 or with a light fixture 10 herewith reference is made to U.S. Pat. No. 6,994,571 the content of which also for the purpose of reference to individual features is herewith incorporated into the content of the present patent application.

In the side flanks of the profile 29] four conductor bars 31, 32, 33 and 34 are disposed electrically isolated from each other. The power rail 28 of the prior art has two null conductors and two phase conductors. With a standard power-rail adapter, for example according to U.S. Pat. No. 6,994,571, in case of wiring as a three-phase power rail a user can select which of the three-phase conductors the respective light fixture will be connected to. This way, three groups of light fixtures can be fixed at a power rail and addressed group-wise in the known manner.

While the cited U.S. Pat. No. 6,994,571 describes a power rail that is formed as a three-phase power rail the same power rail is also commonly used in the USA and is there connected up as a two-phase power rail. This way, the power-supply lines 31, 32, 33 and 34 are wired such that two of the conductors are connected as null conductors and two of the conductors are connected as phase conductors.

According to the invention the standard two-phase power rail can be wired such that two of the four conductors, e.g. the conductors 33 and 34 or alternatively the conductors 32 and 34 or alternatively the conductors 31 and 33 are wired as a signal line through which control information can be transmitted to the light fixture 10. Assuming the first-mentioned example, both remaining conductors 31 and 32 are still used as power-supply lines for the light fixture and are wired accordingly as a phase conductor and as a null conductor. While the power-supply lines 31 and 32 that thus correspond to the power-supply lines 19*a* and 19*b* of FIG. 3 transmit a high operating voltage of e.g. 120 V only control information of a lower voltage of for example 25V is transmitted through the conductors 33 and 34 that correspond to the signal lines 20*a* and 20*b* of FIG. 3.

The wiring according to the invention of the known power rail provides on the one hand that the signal lines 33 and 34 of the power rail 28 are connected to a not illustrated controller of a network of the light fixtures, the not illustrated control supplying the control information to the signal lines 33 and 34. If bidirectional transmission of control information is provided then the information can be also decoupled from the signal line 33 and 34 if necessary.

The wiring according to invention of the known power rail 28 provides further that the light fixture 10 to be connected to the power rail 28 and/or an operating unit 15 for the light fixture assigned to the light fixture and/or a power-rail adapter 39 for connecting the light fixture 10 to the power rail 28 provides a second connection 18 or corresponding connection points 24*a* and 24*b* that can be connected to the conductors 33 and 34 of the power rail 28, control information being transmitted through this connection 18 or through these connection points 24*a* and 24*b*.

Figure 2:
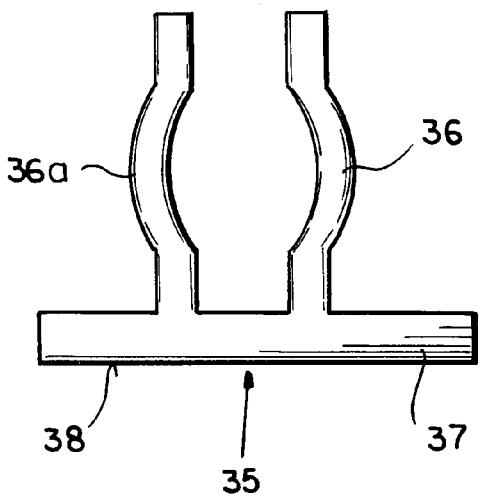
FIG. 2 shows in schematic view a sample of a tag according to the invention.

FIG. 2 shows a tag 35 indicated merely schematically and constituted as a clip that has a cover plate 37 and two spring legs 36*a* and 36*b*. In the installation direction of arrow E the tag 35 can be fitted into the slot 30 of the power rail 28 and firmly clipped there, with introduction of the tag 35 the two free ends of the spring legs 36*a*, 36*b* moving together and then slightly expanding again after achieving a resting position preferably arrested by means of an abutment such that a secure fit of the tag 35 in the power rail 28 is attained.

The cover plate 37 is provided on its bottom side with an indicia region 38 that can be written on and can contain for example indicia that indicates that the power rail 28 is wired a certain way. Preferably the tag 35 indicates that due to the wiring according to the invention the standard power rail 28 is in a state in which the conductors 33 and 34 are wired as signal lines.

Due to the tag 35 the wiring of the power rail 28 is indicated to the user in a simple way, a conceivably simple way of indication being provided through the clippable design of the tag 35.

In this way a user can obtain an information from the tag 35 whether a light fixture provided for example with a DALI ballast can be inserted into this power rail or not.

In the following the power-rail adapter according to the invention will be described with reference to FIGS. 5 to 13:

FIG. 5 shows the power-rail adapter according to the invention in a perspective view that is referred to with 39 in its entirety. Both housing halves 40*a* and 40*b* are open. The housing corresponds with regard to its basic structure substantially to the housing of the power-rail adapter according to U.S. Pat. No. 6,994,571 the content of which is herewith incorporated into the content of the present application to avoid repetition and for the purpose of reference to individual features.

Figure 6:
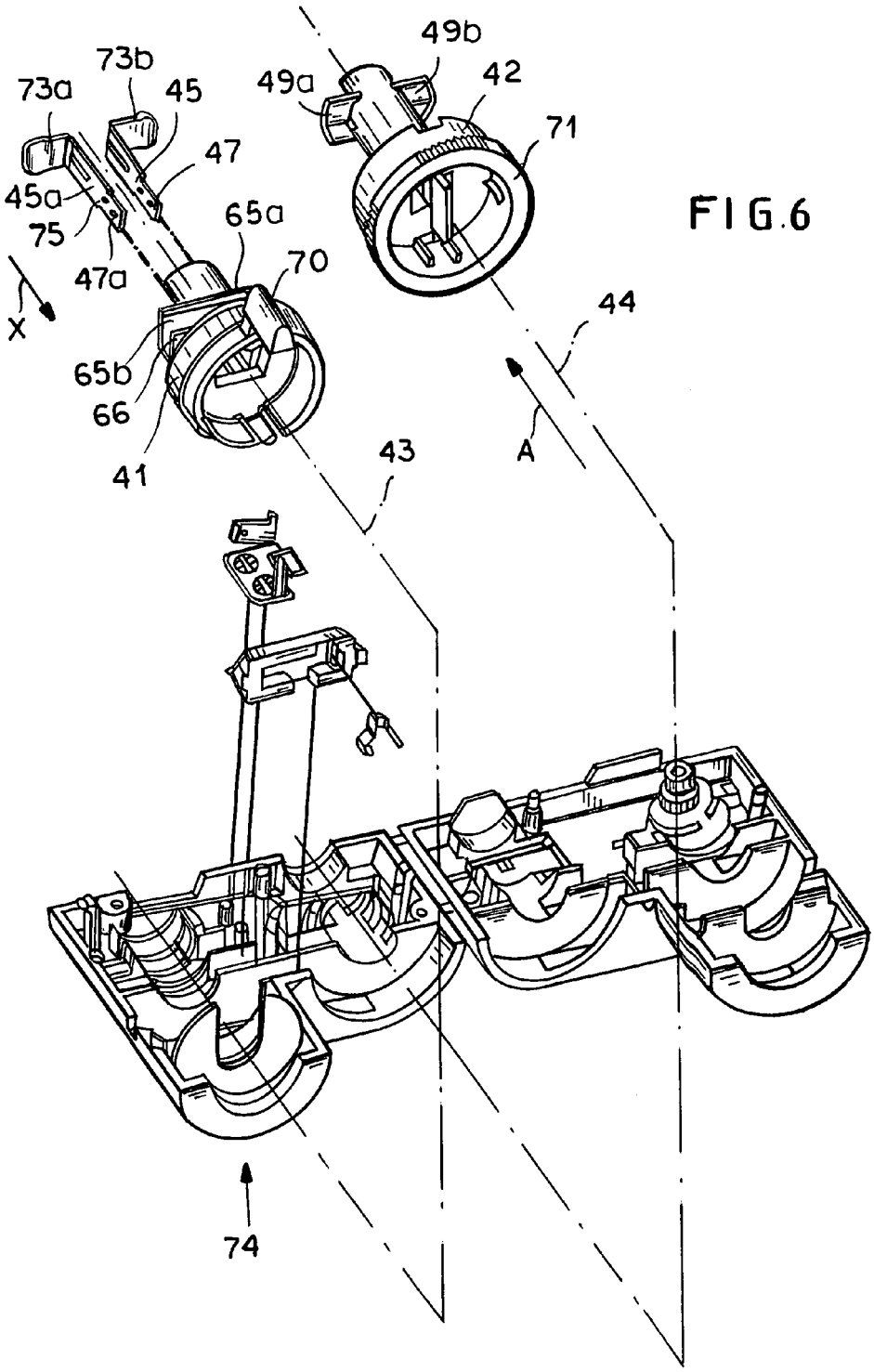
FIG. 6 shows the power-rail adapter according to FIG. 5 in perspective exploded view.

As with the known power-rail adapter, two switch shafts 41 and 42 are pivotally arranged around their respective longitudinal axis 43 and 44 as shown in FIG. 6 in one of the two housing halves, namely in the housing half 40*a* on the left with respect to FIG. 5. The first switch shaft 41 can be actuated in a simple way by manual actuation of an operating lever 70 and the second switch shaft 42 can be actuated by an actuation at a knurled broad edge 71.

For mounting the power-rail adapter 39 the two housing halves 40*a* and 40*b* are pivoted against each other around an axis of a membrane hinge and clipped together. The head region of the power-rail adapter 39 generally referred to at 72 in FIG. 5 is introduced into the slot 30 of the power rail 28 according to FIG. 1 for mounting on the power rail 28.

In the mounted state the first switch shaft 41 is first turned about 90° so that contact terminals 73*a* and 73*b*, holding lugs 65*a* and 65*b* as well as a coding stud 66 to be described later project from slits in the housing halves 40*a* and 40*b* and enter into the respective grooves 78*a*, 78*b* and 77 (FIG. 1) in the power rail 28 and the terminals 73*a* and 73*b* can contact the respective conductors 31 and 32. Then also the second switch shaft 42 can be pivoted about 90° so that corresponding contact terminals 73*c* and 73*d* (FIG. 7) project from corresponding slits or openings in the housing and contact the conductors 33 and 34.

Due to a rotation of the first switch shaft 41 a mechanical and electrical connection takes place at the same time. By rotation of the second switch shaft 42 an electrical connection is effected.

Figure 13:
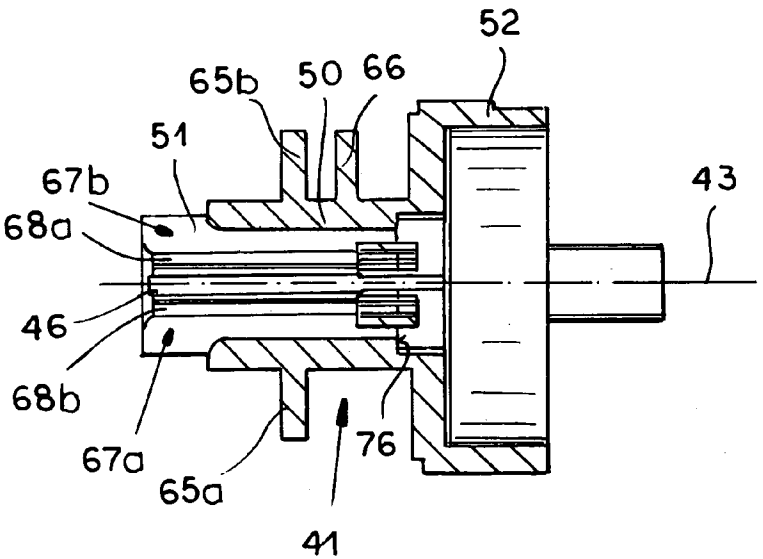
FIG. 13 shows with respect to FIG. 6 the switch shaft on the left in a schematic sectional view like FIG. 11.
Figure 12:
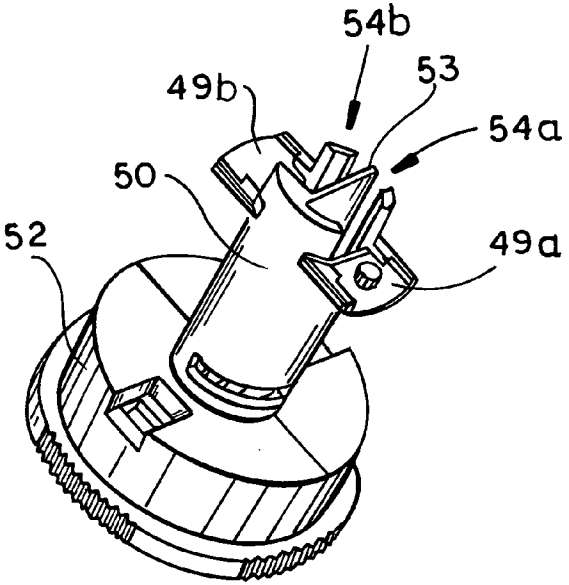
FIG. 12 shows the switch shaft according to FIGS. 10 and 11 in a perspective angular view.

A substantial specific feature according to the invention is that a coding stud 66 is provided on the first switch shaft 41 that can be seen especially with FIGS. 6 and 13. This coding stud can engage the seat groove 77 (FIG. 1) in the power rail 28 when the switch shaft 41 of the power-rail adapter 39 is turned from the removing position about 90° into its installing position. This way the power-rail adapter 39 is accurately oriented with respect to the power rail 28. An incorrect, wrong orientation of the power-rail adapter 39 with respect to the power rail 28 is impossible because the coding stud 66 cannot project into the groove 79 opposite the coding groove 77. This results from the geometry of the power rail 28 according to FIG. 1 because the coding stud 66 is substantially larger than the groove 79. In case of an incorrect orientation of the power-rail adapter 39 with respect to the power rail 28 pivoting of the switch shaft 41 is blocked after a rotation about a certain small angle, for example 30° or 40° and before engagement of the contact terminals 73*a* and 73*b* with the corresponding conductors 31 and 32.

Thus, the coding stud 66 guarantees in interaction with the coding groove 77 a predetermined relative orientation of the power-rail adapter 39 with respect to the power rail 28.

Here the previously described removable fuse or lead fuse can be omitted basically because it is guaranteed that the signal-line conductors at the light fixture or at the operating unit for the light fixture are always brought into connection with the corresponding conductors of the power rail 28 connected as signal line and at the same time it is prevented that an operating voltage is applied at the signal-line conductor.

It will be noted that it is not decisive for the principle according to the invention whether and which contact terminals are provided on, the switch shaft that also supports the coding stud. It is critical that one of the switch shafts has a coding stud 66 that provides for a relative, correct orientation of the power-rail adapter 39 with respect to the power rail 28.

In a not illustrated embodiment for example also only a single switch shaft can be provided that has both a coding stud as well as four contact terminals. In a further not illustrated embodiment more than two switch shafts can be provided of which at least one switch shaft is equipped with the coding stud. Finally, also more switch shafts can be provided each with a contact terminal.

Finally, the distinct designs of the switch shaft illustrated in the figures are to be understood only exemplarily. Alternatively to the illustrations according to FIGS. 11 and 13 in which each of two contacts terminals expand diametrically apart, i.e. away from each other, especially also switch shafts can be provided at which each of two contact terminals are disposed that expand away from the pivoting axis parallel to the same direction.

Both switch shafts 41, 42 can be coupled to each other through a locking arrangement such as already in the case of the known power-rail adapter such that the second switch shaft 42 can be only turned into its contacting or installing state when the first switch shaft 41 is in a contacting or installing state. Such a locking arrangement possibly can be also omitted in the case of the power-rail adapter according to the invention.

Figure 7:
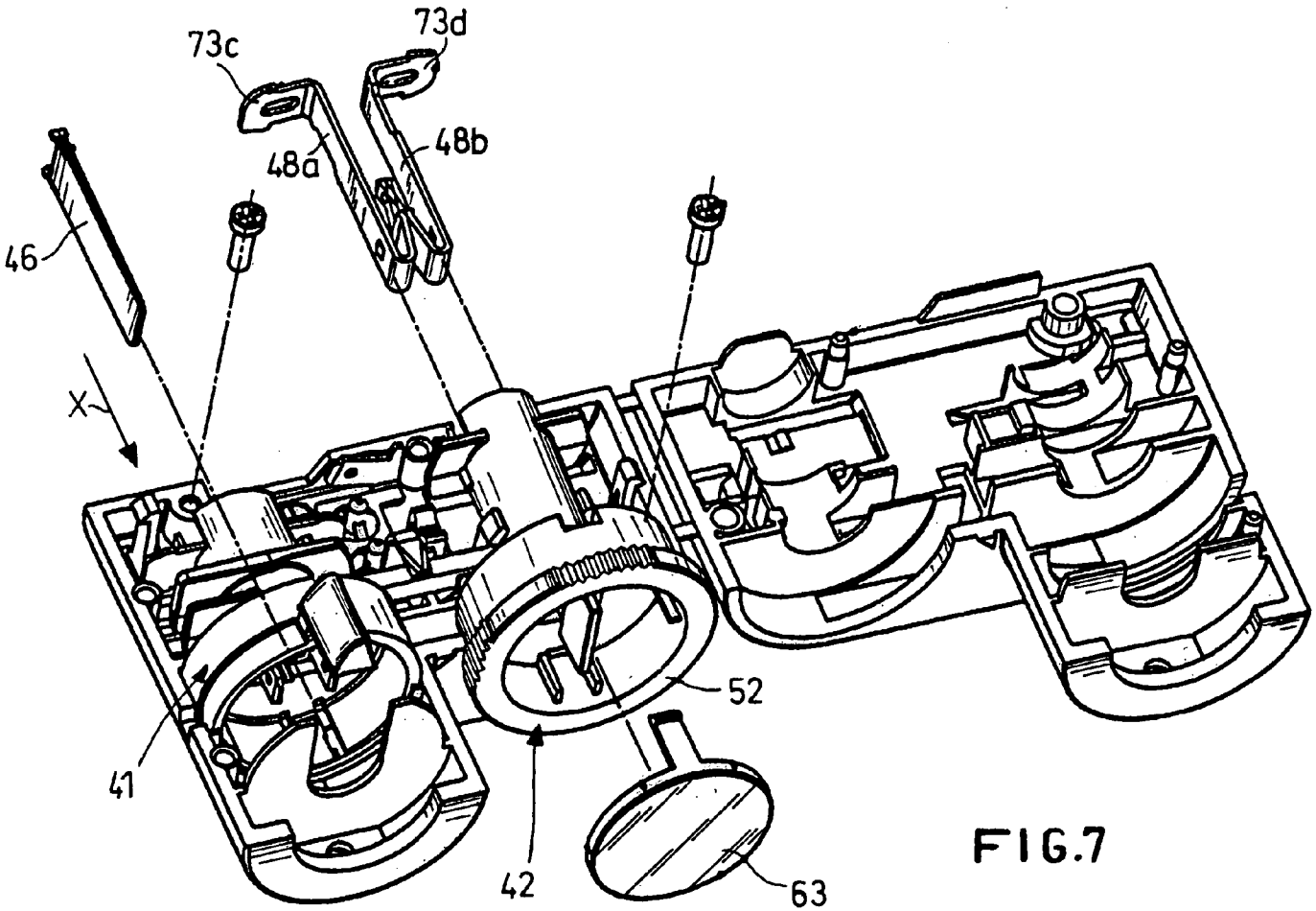
FIG. 7 shows an altered perspective exploded view in a representation like FIG. 6 with other parts.
Figure 10:
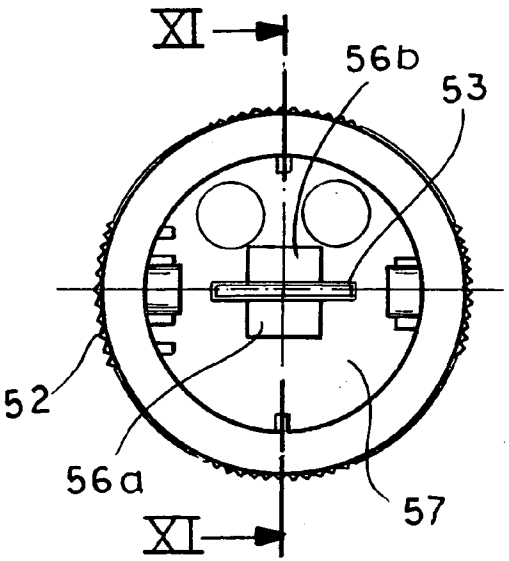
FIG. 10 shows with respect to FIG. 6 the switch shaft on the right in bottom view, generally according to arrow A in FIG. 6.
Figure 9:
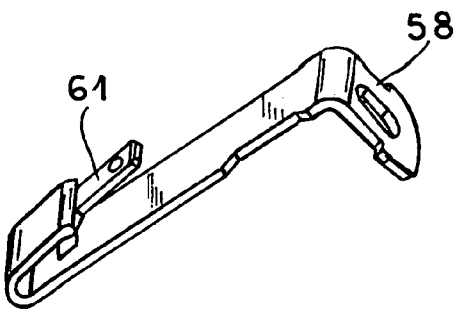
FIG. 9 shows the contact element of FIG. 8 in perspective view.
Figure 11:
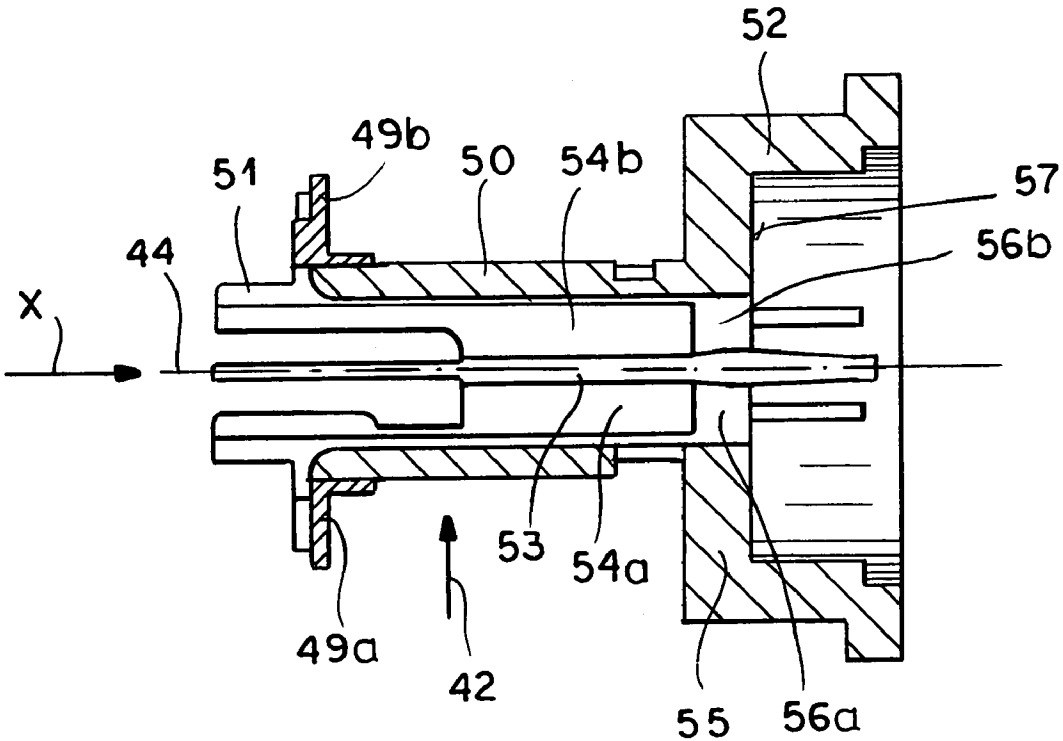
FIG. 11 shows the switch shaft according to FIG. 10 in a schematic partially sectional view, generally according to section line XI-XI in FIG. 10.

FIG. 7 indicates in an exploded view that two contact elements 48*a* and 48*b* are mounted in the second switch shaft 42 that can be plugged into the hollow switch shaft 42 in the inlet direction x (FIG. 6). The switch shaft 42 is shown in FIG. 11 in longitudinal section and comprises a head 51, an axle 50 and a foot 52 that is clearly of larger diameter than the head 51. The switch shaft 42 is hollow along its entire length and comprises two passages 54*a* and 54*b* separated from each other by a partition 53. The partition 53 and the switch shaft 42 are made of an electrically insulating material, preferably of plastic and are manufactured as molded components. The foot 52 has a plate 55 that is provided with two apertures 56*a* and 56*b* such that the switch shaft 42 is provided with a continuous passage along its total axial length.

Figure 8:
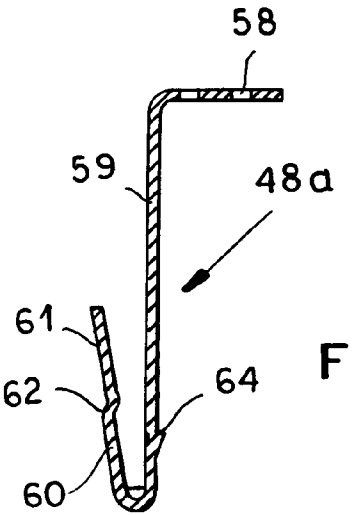
FIG. 8 shows a contact element for a switch shaft in a sectional view.

A contact element 48*a* to be fitted in the second switch-shaft 42 is illustrated in FIG. 8 in cross section. It comprises a region 58 for the formation of the contact terminal 49*a* or 49*b* that contacts the corresponding conductor bar (e.g. conductor 33 or 34 according to FIG. 1) in the power rail 28 and that is bent substantially perpendicularly from a middle region 59. An end region 60 of the contact element is bent over and forms a plug element 61 constituted as a plug terminal at its free end. An offset 62, i.e. a step, shifts the plug element 61 with respect to the end region 60 slightly parallel. A nose 64 is provided on the side of the middle region 59 not facing the plug element 61.

The two contact elements 48*a* and 48*b* are now plugged in from the left with respect to FIG. 11 into the two passages 54*a* and 54*b* of the second switch shaft 42 in the inlet direction x until the respective locking nose 64 engages the back side 57 of the plate 55 and axially fixes the contact element 48*a* and 48*b* in the second switch shaft 42 in this way. During the insertion the free end 61 of the end region 60 is clamped at the middle region 59 of the contact element 48*a* or 48*b* such that a locking resilient fit of the contact element 48*a* or 48*b* can be achieved at the switch shaft 42. When the locking nose 64 engages the plate 55, the contact region 58 rests on the corresponding holding terminal 49*a* and 49*b* of the switch shaft 42 imparting high stability.

In the mounted state the two contact elements 48*a* and 48*b* are separated from each other by the partition 53 in an electrically safe way. The connections for the two contact elements 48*a* and 48*b* leading to the second connection 18 of the operating unit 15 or of the light fixture 10 and not illustrated in FIG. 11 each have a flat pin bushing at their end that can be brought into connection with the plug terminal 61. Mounting of the flat pin bushing at the plug terminal 61 can also be carried out before the contact element 48*a* or 48*b* is plugged into the second switch shaft 42. In this case the contact element 48*a* or 48*b* and the flat pin bushing are mounted at the switch shaft 42 together with the end of the line connection.

In the mounted state the plug terminal 61 is slightly spaced from the partition 53 due to the bend 62 such that there is sufficient space for the not illustrated flat pin bushing. Basically, this also allows mounting the line connection to the flat pin bushing at the contact element 48*a*, or 48*b* when the contact element is already fixed at the switch shaft 42.

It is important that the plug terminal 61 extends both substantially along the pivot axis 44 of the second switch shaft 42 and is directed in the direction to the base of the profile 29 of the conductor bar 28 in the mounted state of the contact element 48*a* or 48*b*. Thus, connection of the plug terminal 61 through the line connection takes place from the above direction with respect to FIG. 8. This allows as only illustrated in outline in FIG. 5 feeding of two connecting wires 69*c* and 69*d* into the switch shaft 42 from this direction. Altogether, this leads to a very space-saving structure of the power-rail adapter 39 that actually does not have to differ externally from the power-rail adapter of the prior art.

It will be noted such as especially results from FIG. 7 that a cover 63 is provided that closes the foot region 52 of the second switch shaft 42 and thus also covers the contact elements 48*a* and 48*b* completely.

In the following the first switch shaft 41 will be described with reference to FIGS. 6 and 13. FIG. 6 shows that the contact elements 45*a* and 45*b* have respective plug elements 47*a* and 47*b*, according to the type of plug terminal at their lower free end. The plug terminal serves for connecting to a mating plug element according to the type of flat pin bushing provided on one end of a connecting wire 69*a* or 69*b* (FIG. 5). At the opposite end of the contact elements 45*a* and 45*b* there are the contact terminals 73*a* and 73*b* that in turn serve for connecting to the conductor bars (e.g. conductors 32 and 31 according to FIG. 1) of the power rail 28.

The contact element 45*a* or 45*b* virtually identically corresponds to the contact element described in FIGS. 9 to 12 in U.S. Pat. No. 6,994,571. Also the mounting of such a contact element 45*a* and 45*b* is described in this patent application such that reference is made thereto to avoid repetition.

A specific feature of the arrangement is now shown by FIG. 5 from which it can be seen that the two line connections 69*c* and 69*d* for the second switch shaft 42 are fed through the first switch shaft 41. Additionally, a ground conductor not illustrated in FIG. 5 can be passed through the switch shaft as a further line connection such as shown in FIG. 2 of U.S. Pat. No. 6,994,571.

Consequently, the first switch shaft 41 is now provided with a first outlet passage 68*a* and a second outlet passage 68*b* for at least two wires 69*c* and 69*d*. The wires 69*a* and 69*b* assigned to the contact elements 45*a* and 45*b* leave the foot region 52 of the first switch shaft 41 together with the wire 69*c* and 69*d* such that the power-rail adapter 39 has a shared outlet 74 (FIG. 6) for all of the four line connections, for a ground conductor, constituting a shared outlet for five line connections. This shared outlet facilitates the connection of the line connections to the light fixture to be connected to the power-rail adapter.

As indicated in FIG. 13 and in FIG. 7 a partition 46 can be provided in the interior of the hollow first switch shaft 41. However, this can be possibly omitted when the wires 69*c* and 69*d* are sufficiently insulated and have for example double insulation.

In addition the first switch shaft 41 differs from the second switch shaft 42 with respect to the retaining tongues 65*a* and 65*b* and the coding stud 66. Altogether, the first switch shaft 41 has a structure that basically identically corresponds to the structure of a switch shaft illustrated in FIG. 8 of U.S. Pat. No. 6,994,571 with the only difference that an additional coding stud 66 is provided according to the invention.

It will be noted that the contact elements 45*a* and 45*b* are fitted into associated passages 67*a* and 67*b* in the first switch shaft 41 and can be axially secured by means of corresponding locking noses 75 (FIG. 6) that engage corresponding wall regions 76 of the first switch shaft 41.

The power-rail adapter 39 according to the invention has two contact elements 45*a* and 45*b* at the first switch shaft 41 that can be brought into contact with the null conductor 31 of the power rail 28 and the phase conductor 32 of the power rail.

The second switch shaft 42 has two contact elements 48*a* and 48*b* that can be brought into contact with the signal lines 33 and 34 of the power rail 28. In this way a light fixture 10 according to FIG. 3 with a single power-rail adapter 39 can be connected to the power rail 28. Thus, the contact terminal 73*a* corresponds for example to a null-conductor contact, the contact terminal 73*b* corresponds to a phase-conductor contact and the contact terminals 73*c* and 73*d* correspond to the signal line contact terminals.

The invention claimed is:

1. In combination:

a power rail comprising a generally longitudinally extending profile having a pair of transversely confronting sides only one of which is formed with a longitudinally extending and inwardly open coding groove, the sides forming a longitudinally extending and open slot, and a pair of upper longitudinally extending and transversely spaced conductors on the profile sides; and an adapter comprising a body fittable to the rail, a switch shaft extending from the body along an axis and pivotal thereabout relative to the body between a removing position and an installed position, the shaft extending into the slot when the body is fitted to the rail, a pair of radially projecting contacts, and a radially projecting coding stud on the shaft, the shaft being rotatable in a first predetermined orientation of the body relative to the rail into the installed position with the coding stud engaging in the coding groove and the contacts engageable with the conductors, the other side of the profile being shaped so as to engage and prevent rotation of the shaft from the removing position into the installed position when the body is not in the first predetermined orientation relative to the rail.

2. The combination according to claim 1 wherein the switch shaft is formed unitarily with the coding stud.

3. The combination according to claim 1 wherein the switch shaft is connected for synchronous movement with the coding stud.

4. The combination according to claim 1 wherein the adapter has at least two switch shafts.

5. The combination according to claim 1 wherein the light fixture or the operating unit for the light fixture can be supplied with operating voltage and with control information through the adapter.

6. The combination defined in claim 1 wherein the body is fittable in a second orientation different from the first orientation to the power rail, the coding stud being blocked by the other side of the profile in the second orientation.

7. The combination defined in claim 1 wherein the contacts project radially from the shaft.

8. The combination according to claim 1, further comprising a light fixture or operating unit for the light fixture having a first connection for a power-supply line and at least a second connection for a signal line for receiving of control information.

9. The combination according to claim 8 wherein the control information corresponds to the DALI protocol.

10. In combination:

a longitudinally extending power rail provided with a first longitudinally extending conductor and a second longitudinally extending conductor both capable of carrying line voltage;

a supply feeding line voltage to the first conductor;

a controller feeding low-power control information to the second conductor;

an adapter fittable to the rail and having a first contact engageable with the first conductor and a separate second contact engageable with the second conductor;

a light fixture mountable on the adapter; and an operating circuit connected to the light fixture for controlling line-voltage flow from the supply through the first conductor to the light fixture in accordance with the control information fed by the controller to the second conductor.

11. The combination according to claim 10 further comprising a tag on the power rail that indicates that at least one of the conductors is used for transmitting the control information.

12. The combination according to claim 11 wherein the tag can be removably mounted the power rail.

13. The combination according to claim 12 wherein the tag can be clipped to the power rail.

14. In combination:

a longitudinally extending power rail provided with a pair of first transversely spaced and longitudinally extending conductors and a pair of second transversely spaced and longitudinally extending conductors; and an adapter having first and second switch shafts rotatable about respective offset first and second axes and provided with respective pair of first and second contacts, the first and second shafts each being rotatable in the adapter into a position with the respective contacts engaging the respective conductors.

15. The combination defined in claim 14, further comprising an operating circuit connected between the light fixture and the contacts for controlling high-power current flow from the supply through the first conductors and terminals to the light fixture in accordance with the control information fed by the controller to the second conductors and contacts.

16. The combination defined in claim 14, further comprising supply means feeding high-power electrical power to the first conductors.

17. The combination defined in claim 16, further comprising control means for feeding low-power control information to the second conductors.

* * * * *